United States Patent [19]

Nylund

[11] 4,013,233

[45] Mar. 22, 1977

[54] BALL MILL

[76] Inventor: Kenneth G. Nylund, Rte. 1, Box 40C, Globe, Ariz. 85501

[22] Filed: July 29, 1976

[21] Appl. No.: 709,591

[52] U.S. Cl. ..... 241/80; 241/70; 241/79.3; 241/171

[51] Int. Cl.[2] ..... B02C 23/12

[58] Field of Search ..... 241/41, 52, 54, 69, 241/70, 71, 72, 79.2, 79.3, 80, 171, 172, 174

[56] References Cited

UNITED STATES PATENTS

| | | | |
|---|---|---|---|
| 655,745 | 8/1900 | Walker | 241/80 |
| 1,368,739 | 2/1921 | Lindhard | 241/70 |
| 1,374,410 | 4/1921 | Jorgensen | 241/70 |
| 2,670,139 | 2/1954 | Treshow | 241/171 |
| 3,231,203 | 1/1966 | Hardinge et al. | 241/70 |

*Primary Examiner*—Granville Y. Custer, Jr.
*Attorney, Agent, or Firm*—John A. Robertson

[57] ABSTRACT

A ball mill including the usual drum and a trommel screen rotatable therewith together with mechanism for returning damaged balls and large pieces of aggregate directly from the trommel screen to the drum. This mechanism comprises a plurality of blades mounted on the inner surface of the cylindrical screen which pick up material in the trommel screen as an incident to rotation thereof and dump it onto a trough which extends from the screen to the drum. A jet of water is introduced into the trough at its outer end and passes the materials back into the drum.

5 Claims, 3 Drawing Figures

BALL MILL

The present invention relates to ball mills and is concerned primarily with mechanism for passing metallic balls and large pieces of ore aggregate directly from the trommel screen back into the drum of the mill.

BACKGROUND OF THE INVENTION

At the present time, ball mills of extremely large size are used in the copper industry to reduce ore to a size sufficiently fine to enable it to be refined in a floatation process. Such a ball mill includes as an essential element a drum which is mounted on a horizontal axis and usually is of a diameter ranging from twenty to thirty feet. A large number of balls are contained within this drum and they usually are of steel. Ore which has been partially reduced in size is fed into the drum at one end together with water. As the drum rotates the action of the balls on the ore aggregate achieves the reduction in size of the aggregate.

At the end of the drum remote from the end at which the ore is introduced thereinto, the drum is provided with a cylindrical throat the inner surface of which carries a spiral blade having a reverse pitch whereby some of the balls and aggregate which enter the throat are thrown back into the drum. Mounted on the outer end of this throat and co-axial therewith is a trommel screen which is cylindrical in shape. Ore aggregate of a predetermined size together with water passes through the screen openings at the bottom of the trommel and falls into a hopper from which it is pumped through a conduit to a cyclone separator located just above the ore entry end of the drum. Ore particles of proper size for the floatation process are drawn off the top of the separator while the remaining aggregate and water are passed back through the entry end of the drum where they are recycled.

Due to the grinding action, many of the steel balls become deformed and out of shape. The end of the trommel screen remote from the drum throat is open and these steel balls together with large pieces of aggregate fall out of the open end, and under present day operating conditions, are discarded as waste because there is no known convenient or practical way for returning them to the drum. While these materials may have some value, it is not sufficiently great to warrant attempt to recycle them in the drum.

OBJECTS OF THE INVENTION

With the foregoing conditions in mind the present invention has in view the following objectives:

1. To provide a ball mill including a cylindrical drum and trommel screen mounted on horizontally aligned axes and communicating with each other by way of a throat at one end of the drum with mechanism for directly returning balls and large size ore aggregate from the trommel screen through the throat to the drum.

2. To provide, in a ball mill of the type noted, mechanism for returning materials from the screen through the throat to the drum which comprises pick up elements carried by the screen on its inner surface and a trough which extends through the trommel screen and throat to the drum and onto which material picked up by the pick up elements fall as an incident to rotation of the trommel screen.

3. To provide, in a ball mill of the character aforesaid, pick up elements on the screen in the form of longitudinally extending blades which are canted with respect to the cylindrical screen and in proper relation to the direction of rotation of the screen to achieve the pick up action.

4. To provide, in a ball mill of the kind described, a trough having an outer end which is up-raised with respect to the axis of the screen and which declines downwardly through the throat and to the drum.

5. To provide, in a ball mill of the type noted, a jet at the outer end of the trough by which water under pressure is introduced into the trough to move the materials therealong and pass them into the drum.

Various other more detailed objects and advantages of the invention such as arise in connection with carrying out the above ideas in a practical embodiment will, in part, become apparent and, in part, be hereinafter stated as the description of the invention proceeds.

SUMMARY OF THE INVENTION

The foregoing objects are achieved by providing a ball mill comprising a cylindrical drum having end plates at each end with one end plate being formed with an entry port for ore aggregate and water and the other end plate having a throat. The drum is mounted on a horizontal axis and co-axial therewith and mounted on the throat is a trommel screen having an open end remote from the throat. The trommel screen includes a cylindrical screen on the inner surface of which are mounted a plurality of angularly spaced longitudinally extending blades. A trough extends from a point beyond the outer end of the trommel screen through the trommel screen and throat to the drum. This trough is declined from its outer upper end to its inner lower end. A water jet is located at the upper outer end of the trough and water under pressure is introduced thereinto to provide a jet which moves materials in the trough therealong and into the drum.

The drum and screen are designed for rotation in one direction and the blades on the screen are canted or tilted in relation to this direction of rotation so that as the screen rotates balls and large size ore aggregate are picked up by the blades and dumped onto the trough. They are there subject to the action of the water jet.

For a full and more complete understanding of the invention, reference may be had to the following description and accompanying drawings wherein.

DESCRIPTION OF A PREFERRED EMBODIMENT

Figure 1:
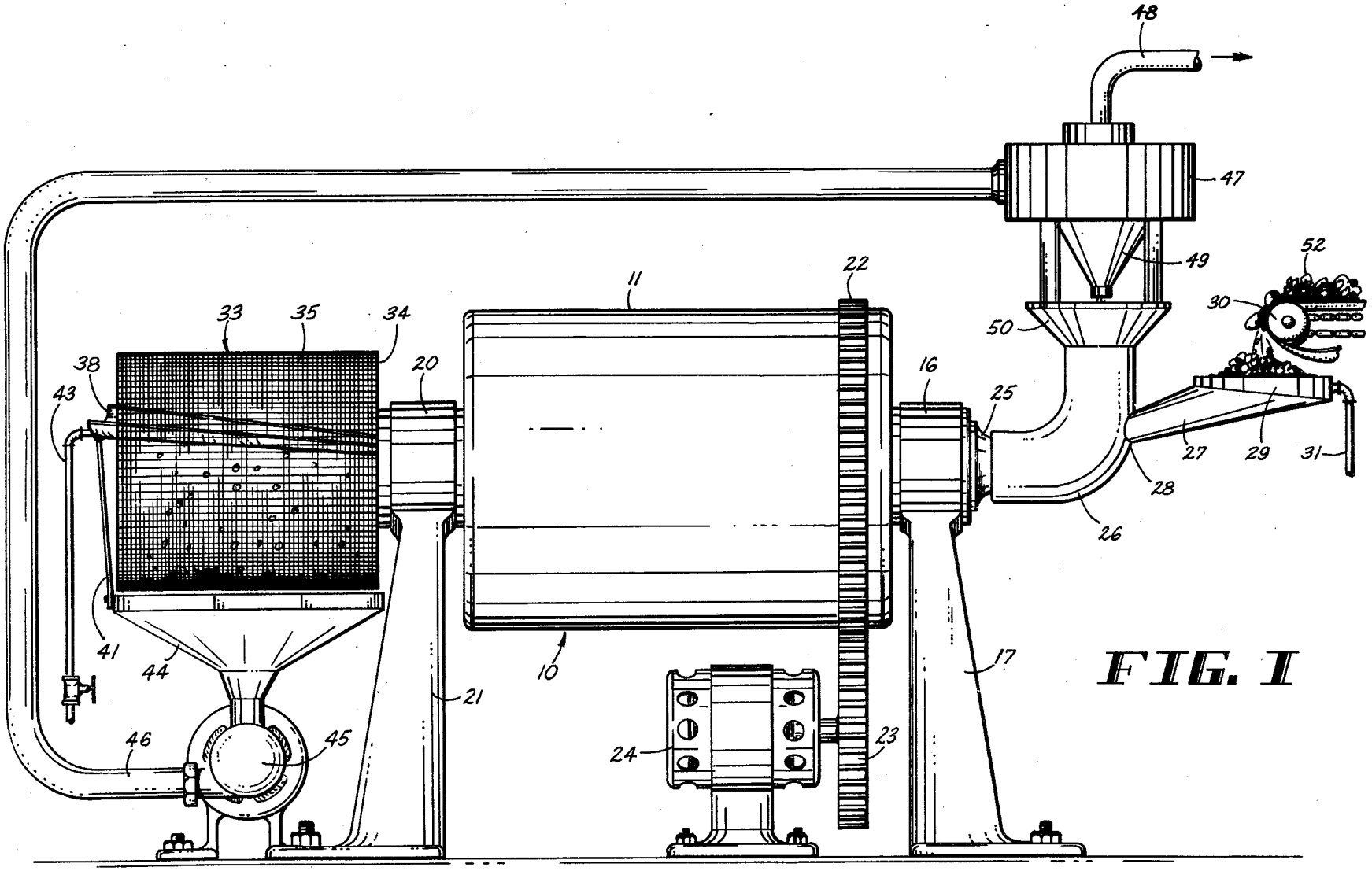
FIG. 1 is a view in side elevation of a ball mill including the improvement of this invention.

Referring now to the drawings wherein corresponding reference characters denote the corresponding elements throughout the several views; a ball mill includes a drum designated generally 10 which comprises an imperforate cylindrical wall 11 and end plates 12 and 13. End plate 12 is formed with an entry port 14 and extending outwardly from end plate 12 at port 14 is a cylindrical neck 15. This neck 15 is journalled in a bearing 16 mounted on the upper end of a standard 17.

End wall 13 is formed with a discharge opening 18 and extending outwardly from wall 13 at opening 18 is a throat 19. This throat 19 is journalled in a bearing 20 mounted in the upper end of another standard 21. The bearings 16 and 20 are in alignment and provide for mounting the drum 10 on a horizontal axis.

Mounted on the exterior surface of cylindrical wall 11 and preferably at the end adjacent to end wall 12 is a large externally toothed ring gear 22. This ring gear 22 meshes with a small gear 23 that is mounted on the drive shaft of electric motor 24. Thus, drum 10 is rotated in a proper direction by motor 24 through the medium of gears 22 and 23.

Secured to the open end of neck 15 is a nipple 25. This nipple 25 communicates with a conduit elbow 26. A chute 27 has one end in communication with elbow 26 as indicated at 28 and its other end takes the form of a horizontal ring 29 which receives ore aggregate from an endless conveyor 30. Water is introduced into chute 27 at ring 29 by a pipe 31.

Figures 2, 3:
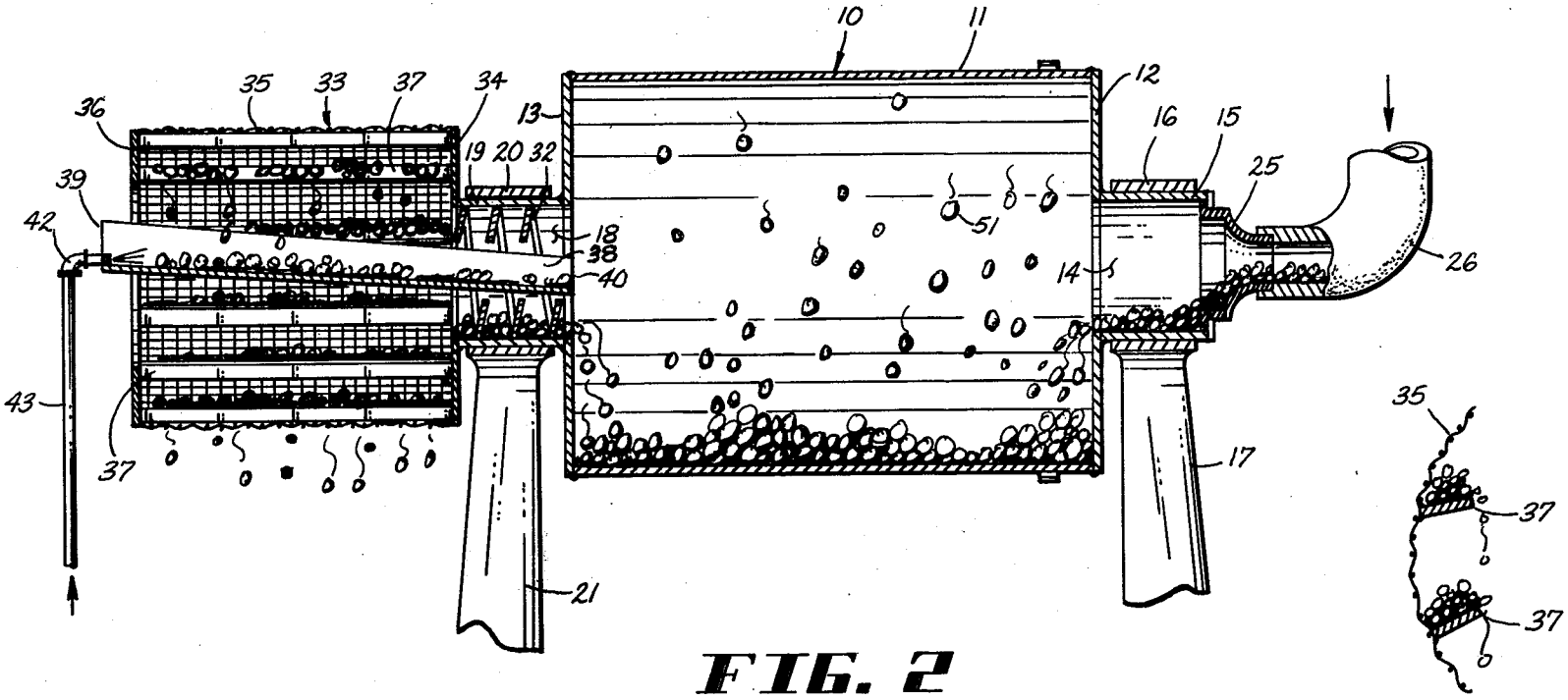
FIG. 2 is a longitudinal vertical section through the apparatus of FIG. 1.
FIG. 3 is a detail taken on a enlarged scale of a portion of the trommel screen with the blades mounted thereon.

As shown more clearly in FIG. 2, a spiral blade 32 is mounted on the inner surface of throat 19 and has a reverse pitch with respect to the direction of rotation of drum 10. Thus, as the throat rotates with the drum it will return some of the materials in the drum back thereinto.

Mounted on the open end of throat 19, that is the end remote from discharge opening 18 is a trommel screen designated generally 33. Trommel screen 33 comprises an end wall 34 which is connected to throat 19 and a cylindrical screen 35 which is open at the end remote from wall 34 with the exception of a small inwardly extending flange 36. Extending between wall 34 and flange 36 are a plurality of longitudinally extending and angularly spaced blades 37.

Referring for the moment more particularly to FIG. 3, it will be noted that blades 37 are canted from a radial position and the direction of this cant is related to the direction of rotation of the screen so that they function as pick up elements which pick up balls and aggregate as the screen rotates.

A trough 38 extends from a point beyond flange 36 through trommel screen 33 and throat 19 to drum 10. Trough 38 is declined from its outer open end shown at 39 to its lower end 40. Trough 38 is supported in this position by a strut 41 which is connected to a fixed member at its lower end as will be later described.

A jet nozzle 42 enters trough 38 at end 39 and water under pressure is delivered thereto by a pipe 43. Positioned below trommel screen 33 is a hopper 44 which received ore aggregate of a size which permits it to pass through the openings of screen 35 together with water. This mixture of water and fine ore aggregate is pumped from hopper 44 by a pump 45 through a conduit 46. The latter extends to a cyclone separator 47. Separator 47 separates the aggregate particles of the size required for a floatation process from the particles of undesirable size. Thus, the properly sized particles are withdrawn through tube 48 from the upper side of separator 47 while the larger particles are passed downwardly through funnel 49 into a receiving spout 50 in the upper end of conduit 26. They are there mixed with aggregate from conveyor 30 and water from pipe 31 and recycled through drum 10 and trommel screen 33.

OPERATION

While the manner in which the subject ball mill operates is believed to be obvious from the illustrations of the drawings and description of parts set forth above, it is briefly outlined as follows:

Before describing the operation it is noted that steel balls are indicated at 51 in FIG. 2 and ore aggregate at 52 in FIG. 1. Ore aggregate 52 passes from conveyor 30 into the upper end of chute 27 where it is mixed with water coming from pipe 31. This mixture of aggregate and water is delivered to conduit 26 and thence into nipple 25, neck 15, and port 14 into the interior of drum 10. As the latter rotates under the influence of motor 24 the balls 51 and aggregate 52 are intermixed with the balls exhibiting a grinding action on the aggregate. There will be a tendency for the major part of this mixture of balls, aggregate, and water to pass out of throat 19. However this tendency is resisted to a degree by spiral blade 32 having a reverse pitch which will return a large amount of the mixture to the drum 10. However, some of this mixture, balls, aggregate, and water pass through throat 19 into trommel screen 33. As the latter rotates there still is some additional grinding action of the balls on the aggregate and the aggregate of a size sufficiently small will fall down through the bottom of screen 35 into hopper 44 and from the latter be pumped by pump 45 through conduit 46 to cyclone separator 47.

As trommel screen 33 rotates, blades 37 function as pick elements which pick up balls and aggregate and as they reach a top position dump these materials onto trough 38. The jet of water emanating from jet nozzle 42 forces the balls and large size aggregate along the trough 38 and delivers them back to drum 10.

It is notable that end 40 of trough 38 is shown as being located at end plate 13. However, the force of the jet will be sufficient to carry these balls and aggregate back pass the transverse center line of the drum.

While a preferred specific embodiment of the invention is herein disclosed it is to be clearly understood that the invention is not limited to the exact constructions, mechanisms, and devices illustrated and described because various modifications of these details may be provided in putting the invention into practice.

What is claimed is:

1. In a ball mill including a drum comprising an imperforate cylindrical wall and end plates at the opposite ends thereof, means for mounting the drum on a horizontal axis, power means for rotating the drum, an entry opening formed in one of said end plates, means for introducing ore aggregate into said drum through said entry opening, a discharge opening in the other of said end plates, a throat at said discharge opening, and a trommel screen mounted on said throat and having an open end remote from said throat; the improvement consisting of: mechanism for returning materials from said trommel screen through said throat to said drum, and comprising:

a. pick up elements on the inner surface of said trommel screen for picking up materials therein as an incident to rotation of said trommel screen, b. a trough extending through said trommel screen, said throat, and to said drum and positioned to receive materials falling from said pick up elements as the latter reaches an upper position as an incident to rotation of said screen; and, c. pressure fluid means for forcing the materials in said trough therealong and into said drum.

2. The ball mill of claim 1 in which the pick up elements take the form of a plurality of angularly spaced longitudinal blades canted out of radial positions with the direction of said canting related to the direction of rotation of the screen.

3. The ball mill of claim 1 in which the trough is inclined from an outer upper end at the open end of the trommel screen to a lower end at said drum.

4. The ball mill of claim 1 in which the fluid means takes the form of a water jet.

5. The ball mill of claim 1 in which a spiral blade is carried by the throat on its inner surface and has a reverse pitch with respect to rotation of the drum.

* * * * *